US010919064B2

(12) United States Patent
Ortiz et al.

(10) Patent No.: US 10,919,064 B2
(45) Date of Patent: Feb. 16, 2021

(54) DISPENSER SYSTEM

(71) Applicants: Thomas Ortiz, Lincoln, NE (US); David Wintroub, Omaha, NE (US); David Murphy, Lincoln, NE (US)

(72) Inventors: Thomas Ortiz, Lincoln, NE (US); David Wintroub, Omaha, NE (US); David Murphy, Lincoln, NE (US)

( * ) Notice: Subject to any disclaimer, the term of this patent is extended or adjusted under 35 U.S.C. 154(b) by 0 days.

(21) Appl. No.: 16/355,098

(22) Filed: Mar. 15, 2019

(65) Prior Publication Data

US 2019/0283058 A1 Sep. 19, 2019

Related U.S. Application Data

(60) Provisional application No. 62/735,610, filed on Sep. 24, 2018, provisional application No. 62/643,855, filed on Mar. 16, 2018.

(51) Int. Cl.

| | |
|---|---|
| ***B05B 11/00*** | (2006.01) |
| ***A45D 34/00*** | (2006.01) |
| ***A47K 5/12*** | (2006.01) |

(52) U.S. Cl.

CPC ..... *B05B 11/3001* (2013.01); *A45D 34/00* (2013.01); *A47K 5/12* (2013.01)

(58) Field of Classification Search

CPC ..... B05B 11/3001; A45D 34/00; A47K 5/12
USPC ..... 222/135, 136, 137, 145.4, 145.5, 145.1, 222/145.6

See application file for complete search history.

(56) References Cited

U.S. PATENT DOCUMENTS 3,850,346 A * 11/1974 Richardson ..... B65D 81/3227 222/145.7
5,339,990 A * 8/1994 Wilder ..... B05B 11/3001 222/135
5,738,248 A * 4/1998 Green ..... B67D 1/0031 222/129.2

(Continued)

FOREIGN PATENT DOCUMENTS

KR 10-2014-0113807 A 9/2014
KR 20-0477910 Y1 8/2015

(Continued)

OTHER PUBLICATIONS

Notification of Transmittal of the International Search Report and the Written Opinion of the International Searching Authority, dated Jun. 28, 2019, PCT/US2019/022554.

*Primary Examiner* — Donnell A Long
(74) *Attorney, Agent, or Firm* — Mallory M. Henninger; Advent, LLP

(57) ABSTRACT

Dispenser systems, dispensers, and repositories can add a fragrance to an unscented liquid beauty preparation. The dispenser system includes a dispenser having a cavity for retaining at least a first liquid, and a repository configured for removably attaching to the dispenser, the repository having a reservoir for retaining at least a second liquid. The dispenser is coupled with a pump assembly including at least one pump for drawing the at least a first liquid and the at least a second liquid into a mixing chamber. The mixing chamber is coupled with an actuator in such a manner that when the actuator is pressed down by an external force, the mixing chamber communicates with the pump to suction the first and second liquids into the mixing chamber to form a liquid mixture for dispensing through a nozzle.

21 Claims, 16 Drawing Sheets

(56) References Cited

U.S. PATENT DOCUMENTS

| | | | | |
|---|---|---|---|---|
| 5,964,377 | A * | 10/1999 | Demarest | B05B 11/3004 222/136 |
| 9,192,949 | B2 * | 11/2015 | Lang | B05B 11/0054 |
| 2003/0123323 | A1 * | 7/2003 | Bublewitz | A61C 9/0026 366/172.1 |
| 2005/0115988 | A1 * | 6/2005 | Law | B05B 7/0037 222/145.5 |
| 2015/0352571 | A1 * | 12/2015 | Petkus | B05B 7/2464 222/1 |
| 2018/0333689 | A1 * | 11/2018 | Richardson | B01F 3/0853 |

FOREIGN PATENT DOCUMENTS

| | | | |
|---|---|---|---|
| KR | 10-2016-0098712 | A | 8/2016 |
| KR | 10-2018-0012622 | A | 2/2018 |
| WO | 2016-099134 | A1 | 6/2016 |

* cited by examiner

DISPENSER SYSTEM

CROSS-REFERENCE TO RELATED APPLICATIONS

The present application claims the benefit under 35 U.S.C. § 119(e) of U.S. Provisional Application Ser. No. 62/643,855, filed Mar. 16, 2018, and titled "FRAGRANCE INFUSION ASSEMBLY," and of U.S. Provisional Application Ser. No. 62/735,610, filed Sep. 24, 2018, and titled "DISPENSER SYSTEM," which are herein incorporated by reference in their entireties.

BACKGROUND

Bottles or containers are used to house liquid beauty preparations (e.g., cleaning agents, hand soaps, hair shampoos, etc.). The liquid preparation is obtained from the bottle/container by hand-squeezing the bottle/container or by a pumping mechanism of the bottle/container.

DRAWINGS

The Detailed Description is described with reference to the accompanying figures. The use of the same reference numbers in different instances in the description and the figures may indicate similar or identical items.

DETAILED DESCRIPTION

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense.

Hair shampoos and other beauty liquid preparations (e.g., conditioner, lotion, hand soap, perfume, cleaning agents, etc.) generally include a fragrance as an essential ingredient. In these preparations, the fragrance is premixed with the liquid preparation, and the liquid preparation is contained in a bottle or container. Because these liquid preparations have a preselected fragrance, it can be difficult to find a liquid preparation that has both the desired qualities (e.g., pleasing foam, ease of rinsing, minimal skin and/or eye irritation, nutrient content, texture, low toxicity, biodegradability, pH, hair and/or skin reparation properties, etc.) and a desired fragrance. Additionally, if a user wishes to have liquid preparations of different fragrances, the user must purchase multiple liquid preparations. For example, if a user wishes to have shampoo fragrances that compliment different body fragrances (e.g. perfumes, colognes, etc.) worn by the user, the user must purchase multiple different shampoos. Further, fragrances are a leading cause of allergic reactions for cosmetic and toiletry products. Thus, if a user is allergic to a particular fragrance or fragrance ingredient, the user's options for beauty preparations are limited, and, vice-versa, if a user is allergic to a particular beauty preparation ingredient, the user's options for a specific fragrance may be limited.

Aspects of the disclosure relate to dispenser systems, dispensers, and repositories for adding a fragrance and/or a color pigment to an unscented liquid beauty preparation. The dispenser system includes a dispenser having a cavity for retaining at least a first liquid, and a repository configured for removably attaching to the dispenser, the repository having a reservoir for retaining at least a second liquid. The dispenser is coupled with a pump assembly including at least one pump for drawing the at least a first liquid and the at least a second liquid into a mixing chamber. The mixing chamber is coupled with an actuator in such a manner that when the actuator is pressed down by an external force, the mixing chamber communicates with the pump to suction the first and second liquids into the mixing chamber to form a liquid mixture for dispensing through a nozzle.

Figure 1:
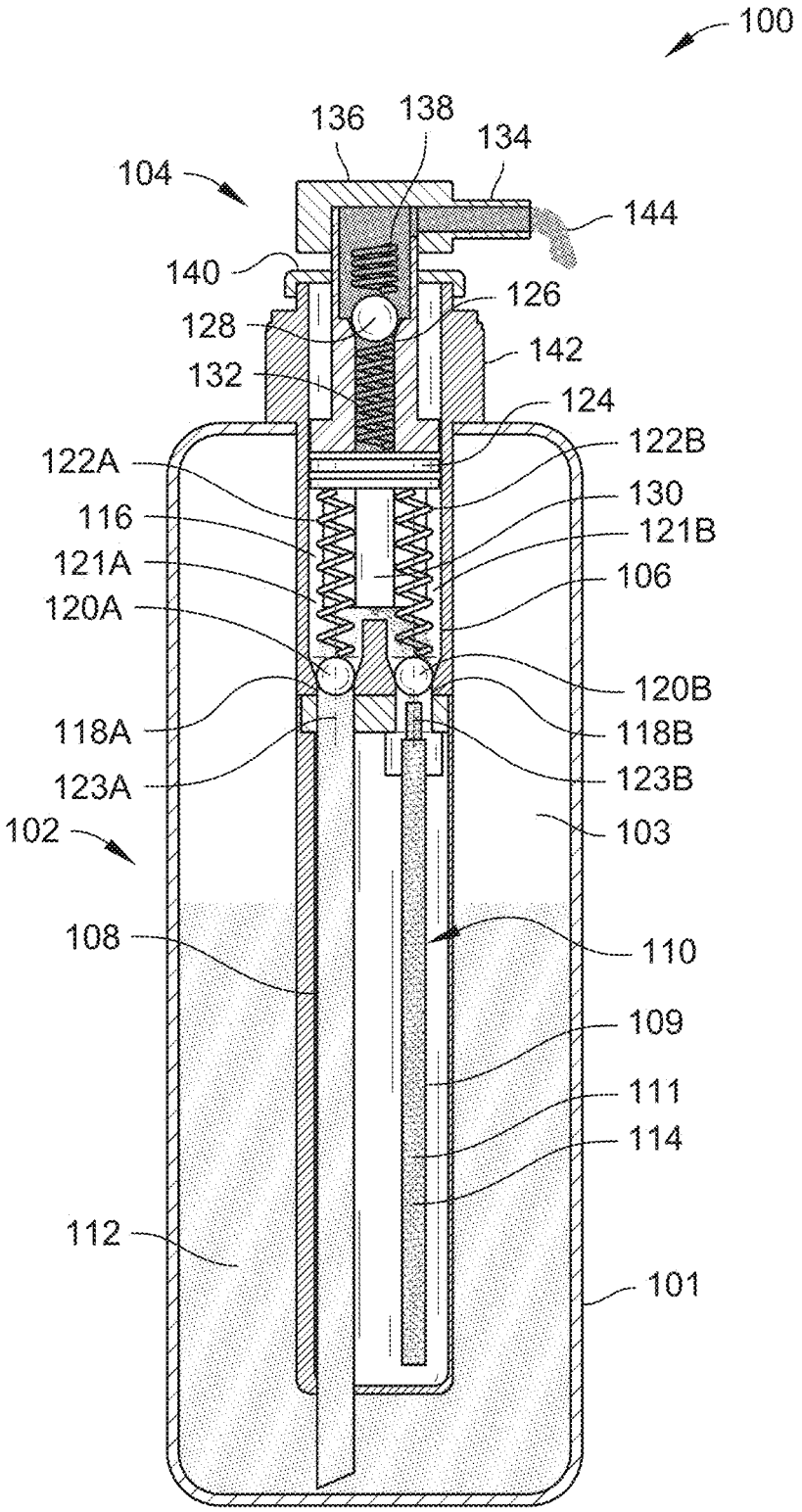
FIG. 1 is a longitudinal cross-sectional view of a dispenser system in accordance with an example embodiment of the present disclosure.
Figure 2:
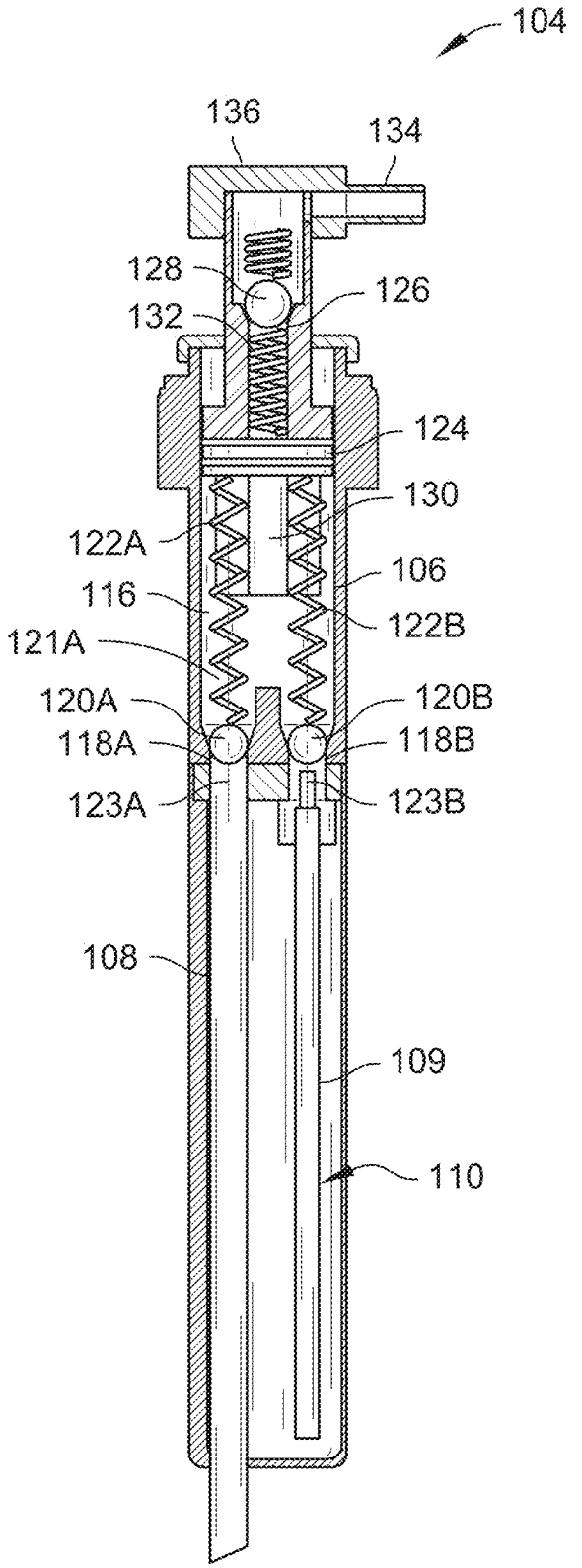
FIG. 2 is a longitudinal cross-sectional view of a pump assembly for a dispenser system, such as the dispenser system of FIG. 1, in accordance with an embodiment of the present disclosure.
Figure 3:
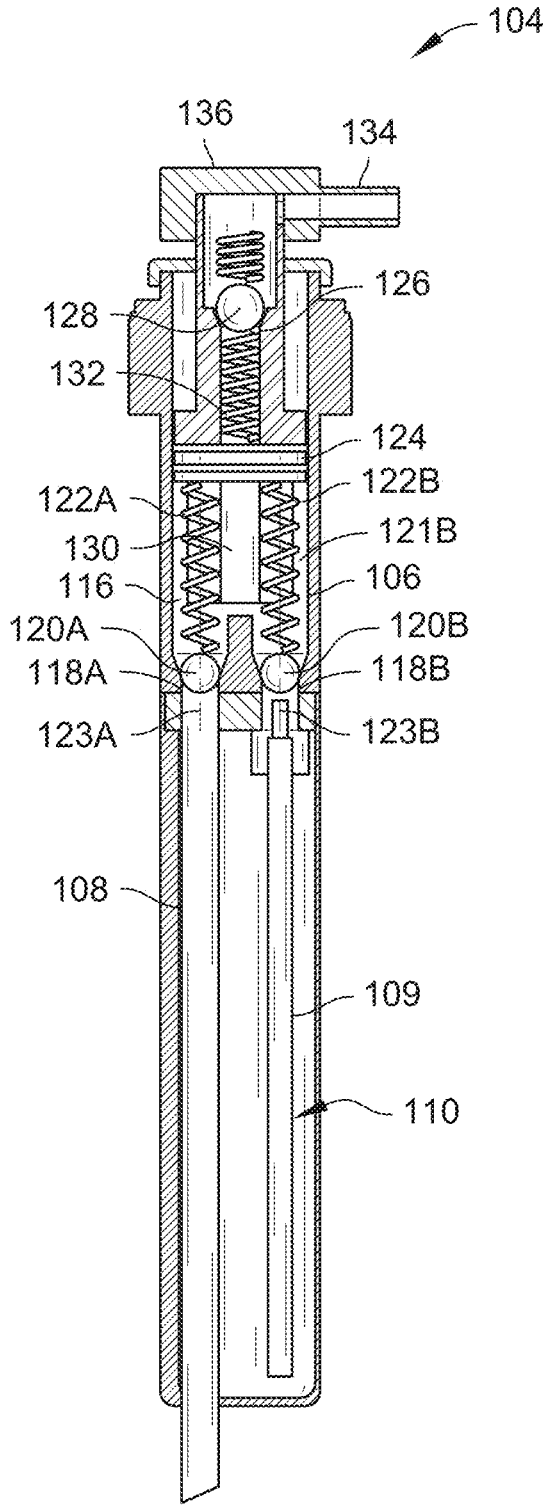
FIG. 3 is a longitudinal cross-sectional view of the pump assembly illustrated in FIG. 2 in operation.

Referring generally to FIGS. 1 through 3, a beauty preparation dispenser system 100 is described in accordance with example embodiments of the present disclosure. The dispenser system 100 includes a dispenser (e.g., a beauty preparation container 102) and a pump assembly 104. In embodiments of the disclosure, the beauty preparation container 102 includes a housing 101 that defines a first reservoir 103 for holding a first fluid (e.g., a first liquid 112) to be dispensed from the beauty preparation dispenser system, such as a conditioner, a lotion, a hand soap, a perfume, a cleaning agent, and so forth. The pump assembly 104 can include a first mixing chamber 106 having at least one hollow dip tube 108 and at least one fragrance container (e.g., fragrance reservoir 110) mounted thereunder. In embodiments of the disclosure, the fragrance reservoir 110 includes a fragrance repository 109 that is removably couplable with the beauty preparation container 102. The fragrance repository 109 defines a second reservoir 111 for holding a second fluid (e.g., a second liquid 114) to be dispensed from the beauty preparation dispenser system, such as a fragrance and/or a color pigment. The dip tube 108 is configured to extend beneath the pump assembly 104 and contact a first liquid 112 stored within the container 102 (e.g., as described with reference to FIG. 1). In some embodiments, the first liquid 112 includes an unscented liquid (e.g., unscented shampoo, unscented conditioner, unscented lotion, etc.). The fragrance reservoir 110 is configured to store a second liquid 114. In some embodiments, the second liquid 114 includes a scented liquid (e.g., a liquid fragrance). In some embodiments, the fragrance reservoir can include a second dip tube configured to contact an external fragrance reservoir (e.g., as described with reference to FIGS. 4 and 5).

In embodiments, the first mixing chamber 106 includes a mixing reservoir 116 and an inner wall defining one or more lower valves. For example, the mixing chamber 106 can define a first lower valve 118A positioned above the dip tube 108, and second lower valve 118B positioned above the fragrance reservoir 110. Seated upon each of the first and second lower valves 118A, 118B is a corresponding lower ball 120A, 120B, respectively. A corresponding compression member (e.g., compression spring 122A, 122B, respectively) is disposed between the lower balls 122A, 122B and a piston 124 disposed in the first mixing chamber 106. As described herein, the first lower valve 118A, the lower ball 120A, and the compression spring 122A form a first pumping mechanism in fluid communication with the first reservoir 103. The first pumping mechanism has a first longitudinal passage 121A for receiving the fluid dispensed from the first reservoir 103, where the first longitudinal passage 121A extends along a first longitudinal axis 123A from proximate to the first reservoir 103 into fluid communication with a nozzle 134. The first longitudinal passage 121A is also in fluid communication with the mixing chamber 106 (e.g., for mixing the first and second fluids together prior to dispensing them from the beauty preparation dispenser system 100).

Similarly, the second lower valve 118B, the lower ball 120B, and the compression spring 122B form a second pumping mechanism in fluid communication with the second reservoir 111. The second pumping mechanism has a second longitudinal passage 121B for receiving the fluid dispensed from the second reservoir 111, where the second longitudinal passage 121B extends along a second longitudinal axis 123B from proximate to the second reservoir 111 into fluid communication with the nozzle 134 when the fragrance repository 109 is coupled with the beauty preparation container 102. The second longitudinal passage 121B is also in fluid communication with the mixing chamber 106 (e.g., for mixing the first and second fluids together prior to dispensing them from the beauty preparation dispenser system 100). In embodiments of the disclosure, the second longitudinal axis 123B is at least substantially parallel to the first longitudinal axis 123A. Further, the first longitudinal axis 123A and the second longitudinal axis 123B are at least substantially parallel to the pumping action direction of the beauty preparation dispenser system 100. A piston 124 is sleeved by the first mixing chamber 106 and is movable along the inner wall of the first mixing chamber 106.

Still referring to FIGS. 1 through 3, an upper valve 126 is positioned above the piston 124, having an upper ball 128 seated thereon. In embodiments, the upper ball 126 and the lower balls 120A, 120B can be formed from a corrosion resistant material including, but not necessarily limited to: stainless steel, chrome, titanium, rubber, other corrosion resistant metals, and so forth. In some embodiments, the upper ball 126 and each of the lower balls 120A, 120B can be formed from the same material. In other embodiments, the upper ball 126 and each of the lower balls 120A, 120B can be formed from one or more different materials.

In embodiments, a second mixing chamber 130 is configured to extend from beneath the upper valve 126 and into the first mixing chamber 106. The second mixing chamber 130 forms a passage from the first mixing chamber 106 to a nozzle 134 of the pump assembly 104. In some embodiments, the second mixing chamber 130 can include one or more mixing members (e.g., a static mixer 132, a bit, a spring, teeth, etc.). The static mixer 132 is configured to provide mixing of liquids within the second mixing chamber 130. In some embodiments, the static mixer 132 is fixedly coupled with the piston 124 to provide dual directional mixing of liquids within the second mixing chamber 130. For example, as liquid(s) pass through the second mixing chamber 130, the static mixer 132 continuously blends the liquids to substantially simultaneously produce both flow diversion and radial mixing. The liquids flow through the static mixer 132 in an alternating clockwise/counter-clockwise pattern. In embodiments, the static mixer 132 includes one or more mixing elements (e.g., baffles). The number of baffles can be selected based on the desired level of stratification of the liquids. For example, at each succeeding baffle, the liquids are further divided, resulting in an exponential increase in stratification. In other embodiments, the mixing member can be rotatably coupled with the piston 124. In embodiments, the baffles can be arranged in a helical configuration. However, these embodiments are offered by way of example only and are not meant to be restrictive of the present disclosure. In other embodiments, the second mixing chamber 130 can form a through passage to the nozzle 134 with no mixing member.

In embodiments, an actuator (e.g. pressing member 136) is disposed above the upper valve 126. In some embodiments, the pressing member 136 includes a biasing member 138 configured for biasing the pressing member 136 and one or more portions of the pump assembly 104. For example, the pressing member 136 can include a biasing spring 138 configured to bias the pressing member 136 with respect to the upper ball 128. The pressing member 136 can be coupled with the second mixing chamber 130 in such a manner that when the pressing member 136 is pressed, the second mixing chamber 130 and the piston 124 move downward.

In some embodiments, the pump assembly further includes a cap member having a cap 140 and a cover 142. The cover 142 is configured for removably attaching the pump assembly 104 to the dispensing container 102. For example, the cover 142 can include threading configured to mate with (e.g., screw on to) a threaded neck of the container 102.

In operation, as shown in FIGS. 1 and 3, when pressing member 136 and the second mixing chamber 130 are pushed downward, piston 124 will be moved downward accordingly. Any air/liquid in the first and/or second mixing chambers 106, 130 will push the upper ball 128 upward, allowing the air/liquid to be discharged from the nozzle 134. After pressing member 136 and the second mixing chamber 130 are depressed to their lowest positions and are released, compression springs 122A, 122B push the piston 124 upward and form a negative pressure vacuum reservoir in the first mixing chamber 106 and allowing the mixing reservoir 116 to communicate with the dip tube 108 and the fragrance reservoir 110. The negative pressure vacuum opens the first lower valve 118A (e.g., lifts lower ball 120A upward) and draws the first liquid 112 through the dip tube 108 and into the first mixing chamber 106 (e.g., into the mixing reservoir 116), and substantially simultaneously opens the second lower valve 118A (e.g., lifts lower ball 120B upward) and draws the second liquid 114 from the fragrance reservoir 110 into the first mixing chamber 106. The first liquid 112 and the second liquid 114 can then mix in the mixing reservoir 116 to form a liquid mixture 144. For example, an unscented shampoo can be mixed with a fragranced liquid to form a fragranced liquid mixture. If pressing member 136 is pressed downward again, the liquid mixture 144 stored in the first mixing chamber 106 will flow through the second mixing chamber 130 passage to be discharged out of the nozzle 134. The movement of the liquid mixture 144 through the second mixing chamber 130 and/or a static mixer 132 can provide further mixing of the liquid mixture 144. For example, the liquid mixture 144 can flow through the static mixer 132 in an alternating clockwise/counter-clockwise pattern, as described above, providing both flow diversion and radial mixing to increase homogeneity of the liquid mixture 144. The lower valves 118A, 118B and the upper valve 126 operate in this way to permit the first and second liquids 112, 114 and the liquid mixture 144 to flow upwards towards the nozzle 134, while preventing backflow of the liquid mixture 144 into the container 102 and/or the fragrance reservoir 110.

Because the pump assembly 104 is removably coupled with the container, the container can be utilized interchangeably with multiple pump assemblies 104. For example, one container of unscented shampoo can be utilized with multiple pump assemblies 104 each containing a different scented liquid 114.

Figure 4:
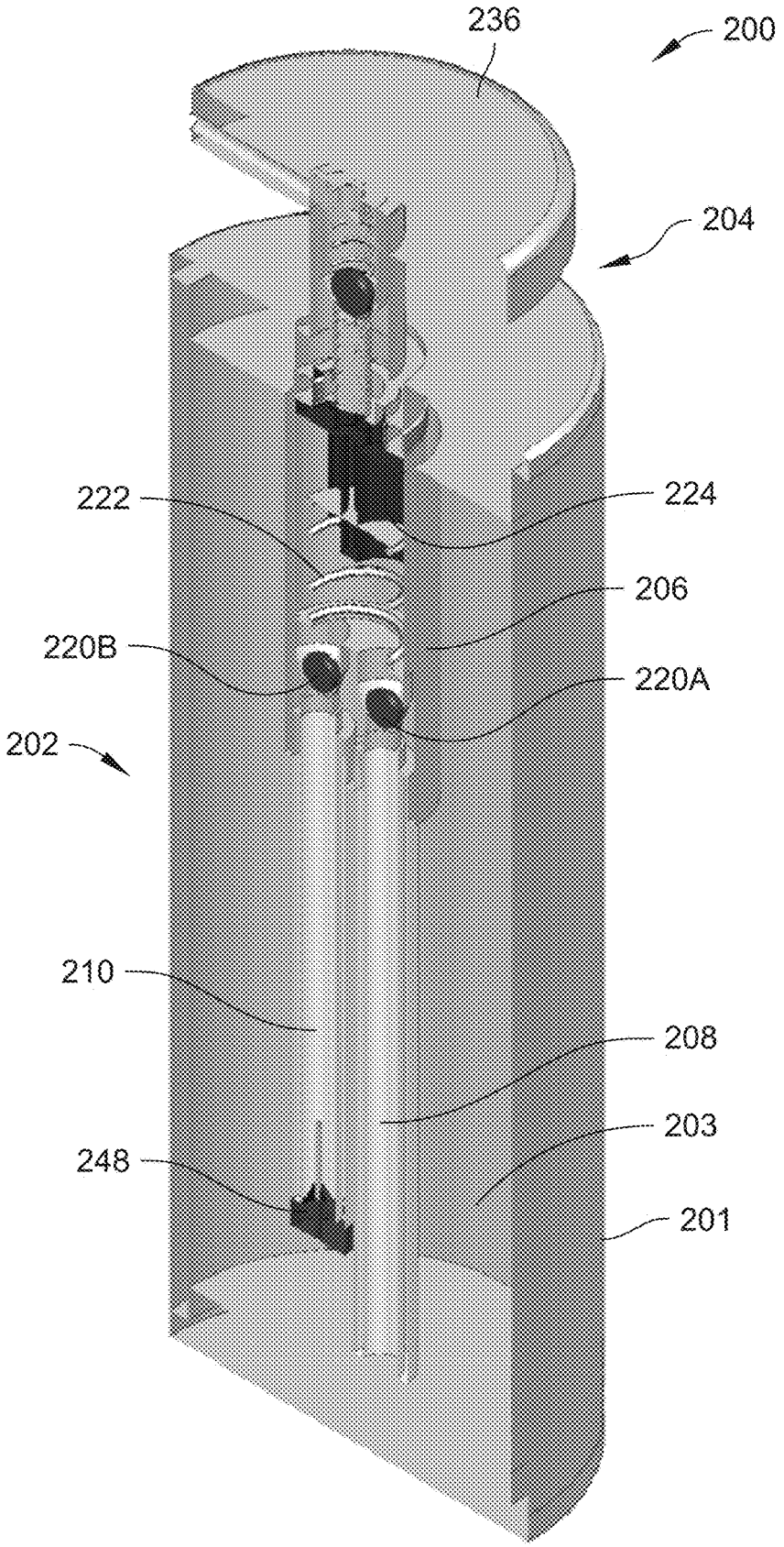
FIG. 4 is an isometric cross-sectional view of a dispenser system in accordance with an example embodiment of the present disclosure.
Figure 5:
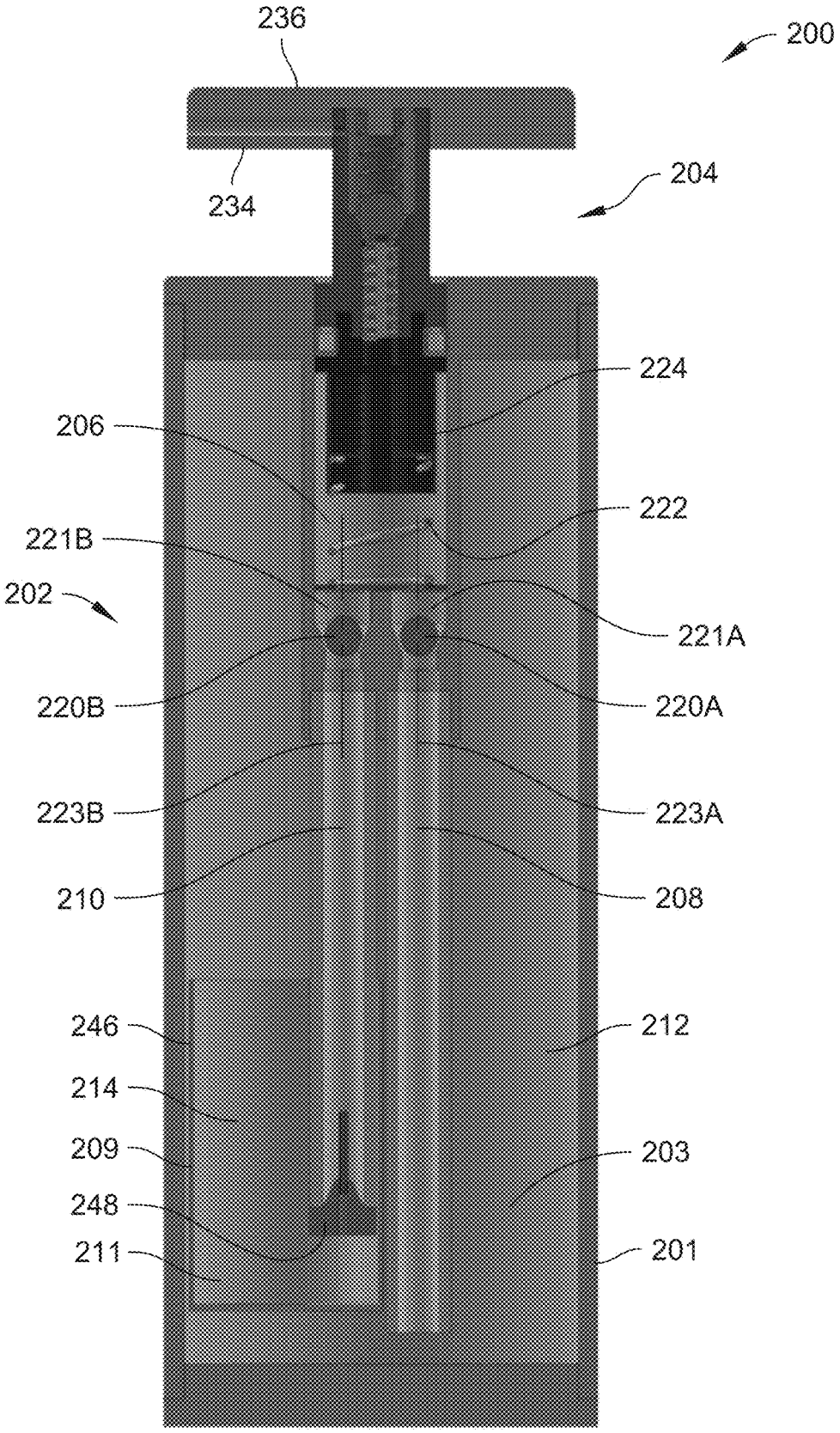
FIG. 5 is a longitudinal cross-sectional view of the dispenser system illustrated in FIG. 4.

Referring now to FIGS. 4 and 5, a beauty preparation dispenser system 200 is described. Unless otherwise stated with reference to FIGS. 4 and 5, substantially analogous features of the dispenser system 200 can interact and operate as described above (e.g., as described with reference to FIGS. 1 through 3). The beauty preparation dispenser system can include a beauty preparation container 202. The beauty preparation container 202 includes a housing 201 that defines a first reservoir 203 for holding a first fluid (e.g., a first liquid 212) to be dispensed from the beauty preparation dispenser system, such as a conditioner, a lotion, a hand soap, a perfume, a cleaning agent, and so forth. As shown and described, a pump assembly 204 can include a first mixing chamber 206 having a first hollow dip tube 208 and a second hollow dip tube 210 mounted thereunder. The first dip tube 208 is configured to extend beneath the pump assembly and contact a first liquid 212 stored within the container 202. In embodiments, the first liquid 212 includes an unscented liquid (e.g., unscented shampoo, unscented conditioner, unscented lotion, etc.). The second dip tube 210 is configured to extend into a fragrance container (e.g., fragrance reservoir 246) configured to store a second liquid 214. In embodiments, the second liquid 214 includes a scented liquid (e.g., a liquid fragrance). In embodiments of the disclosure, the fragrance reservoir 246 includes a fragrance repository 209 that is removably couplable with the beauty preparation container 202. The fragrance repository 209 defines a second reservoir 211 for holding a second fluid (e.g., a second liquid 214) to be dispensed from the beauty preparation dispenser system, such as a fragrance and/or a color pigment. In some embodiments, the second dip tube 210 can be integral with the fragrance reservoir 246, with the second liquid 214 housed within the tube (e.g., as described with reference to FIGS. 1 through 3).

In embodiments, the first dip tube 208 and/or the second dip tube 210 can include an inlet 248 (e.g., a needle) configured for controlling the volume of liquid 212, 214 entering the respective dip tube 208, 210. For example, the second dip tube 210 can include an inlet 248 configured for controlling the amount of the second liquid 214 entering the second dip tube 210. The mixing ratio (e.g., ratio of the first liquid 212 to the second liquid 214 entering the first mixing chamber 206) of the first liquid 212 to the second liquid 214 can be controlled by adjusting the diameter of the inlet(s) 248. For example, an inlet 248 with a larger diameter will permit a greater volume of scented liquid to enter the second dip tube 210. In embodiments, the mixing ratio of the first liquid 212 to the second liquid 214 can be in the range of about 1:0.0001 to about 1:0.5. In specific embodiments, the mixing ratio of the first liquid 212 to the second liquid 214 can be in the range of about 1:0.005 to about 1:0.05 (e.g., between about 1:0.005, 1:0.008, 1:0.010, 1:0.013, 1:0.015, 1:0.018, 1:0.020, 1:0.023, 1:0.025, 1:0.028, 1:0.030, 1:0.033, 1:0.035, 1:0.038, 1:0.040, 1:0.043, 1:0.045, 1:0.048, 1:0.050, and so forth).

Still referring to FIGS. 4 and 5, the dispenser system 200 can further include a single compression member (e.g., compression spring 222) disposed between first and second lower balls 220A, 220B and a piston 224. When the piston 224 is depressed and released (e.g., by depressing and releasing a pressing member 236), the compression spring 222 operates analogously to the dual compression spring arrangement (e.g., compression springs 122A, 122B) described above (e.g., with reference to FIGS. 1-3). For example, the compression spring 222 pushes piston 224 upward to form a negative pressure vacuum reservoir in the first mixing chamber 206 and allowing the first mixing chamber 206 to communicate with the first dip tube 208 and the second dip tube 210. In other embodiments, dual compression springs can be utilized, as described above (e.g., as described with reference to FIGS. 1 through 3).

Referring now to FIG. 5, the lower ball 220A and the compression spring 222 form a first pumping mechanism in fluid communication with the first reservoir 203. The first pumping mechanism has a first longitudinal passage 221A for receiving the fluid dispensed from the first reservoir 203, where the first longitudinal passage 221A extends along a first longitudinal axis 223A from proximate to the first reservoir 203 into fluid communication with a nozzle 234. The first longitudinal passage 221A is also in fluid communication with the mixing chamber 206 (e.g., for mixing the first and second fluids together prior to dispensing them from the beauty preparation dispenser system 200).

Similarly, the lower ball 220B and the compression spring 222 form a second pumping mechanism in fluid communication with the second reservoir 211. The second pumping mechanism has a second longitudinal passage 221B for receiving the fluid dispensed from the second reservoir 211, where the second longitudinal passage 221B extends along a second longitudinal axis 223B from proximate to the second reservoir 211 into fluid communication with the nozzle 234 when the fragrance repository 209 is coupled with the beauty preparation container 202. The second longitudinal passage 221B is also in fluid communication with the mixing chamber 206 (e.g., for mixing the first and second fluids together prior to dispensing them from the beauty preparation dispenser system 200). In embodiments of the disclosure, the second longitudinal axis 223B is at least substantially parallel to the first longitudinal axis 223A. Further, the first longitudinal axis 223A and the second longitudinal axis 223B are at least substantially parallel to the pumping action direction of the beauty preparation dispenser system 200.

Figure 6A:
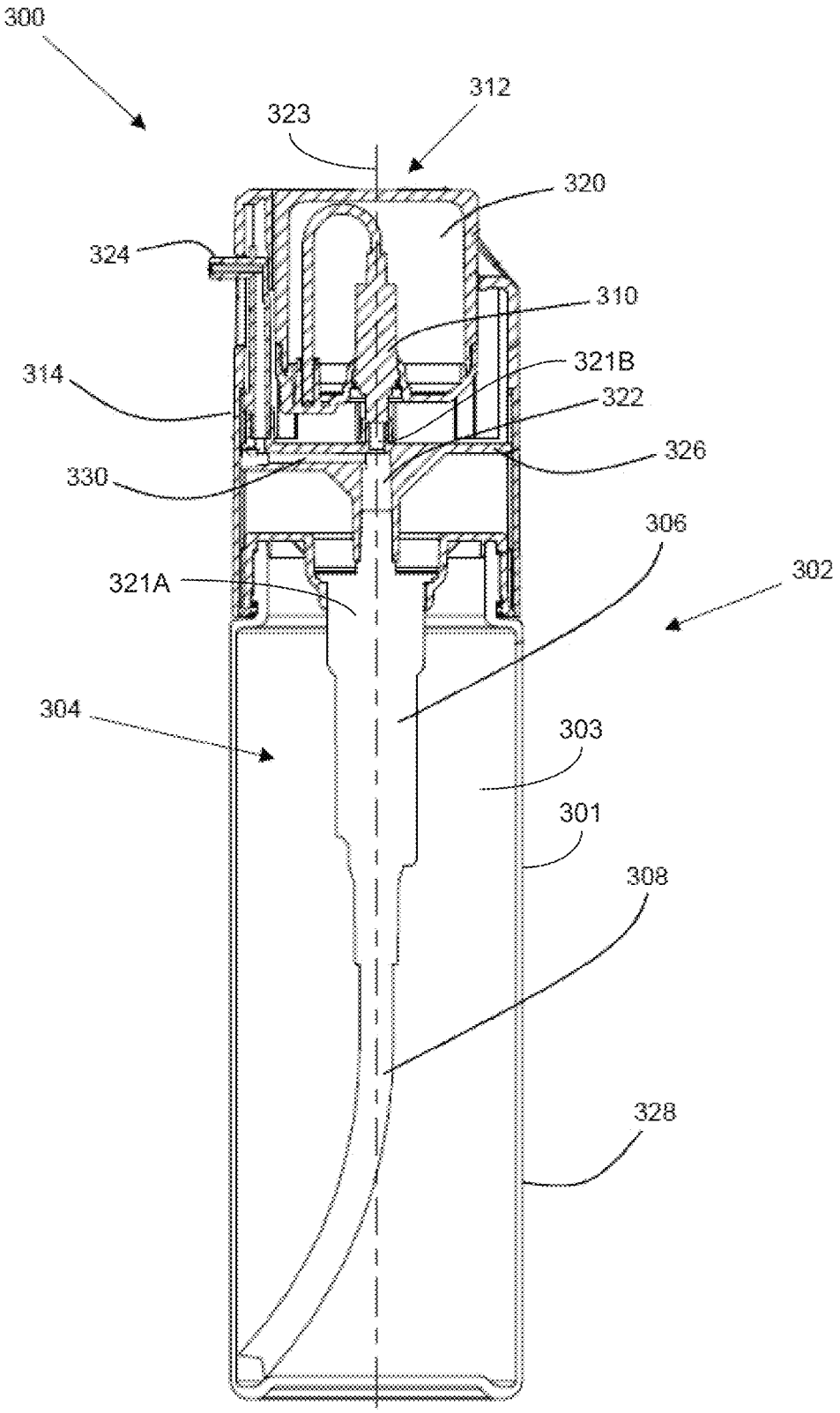
FIG. 6A is a longitudinal cross-sectional view of a dispenser system in accordance with an example embodiment of the present disclosure.
Figure 6B:
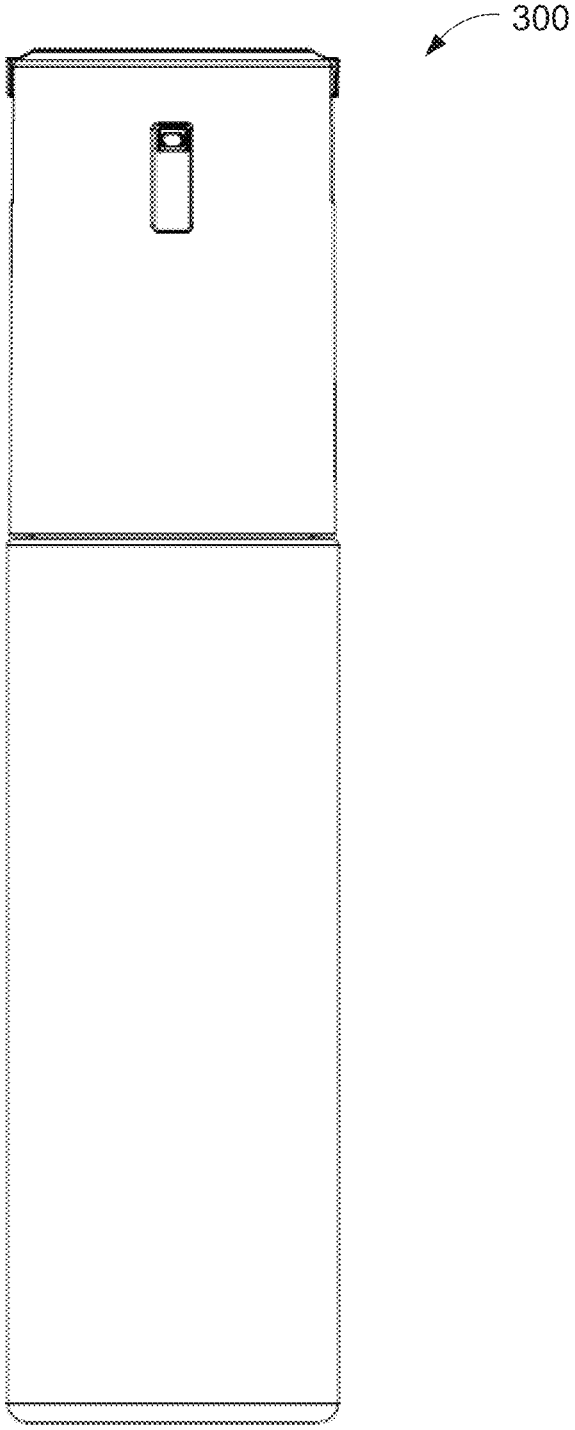
FIG. 6B is a front view of a dispenser system, such as the dispenser system of FIG. 6A, in accordance with an embodiment of the present disclosure.
Figure 6C:
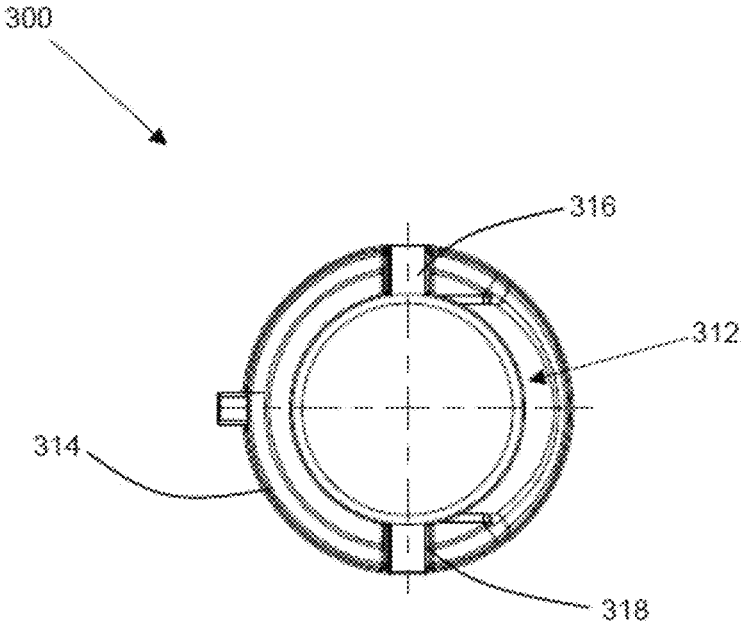
FIG. 6C is a top plan view of a dispenser system, such as the dispenser system of FIG. 6A, in accordance with an embodiment of the present disclosure.
Figure 6D:
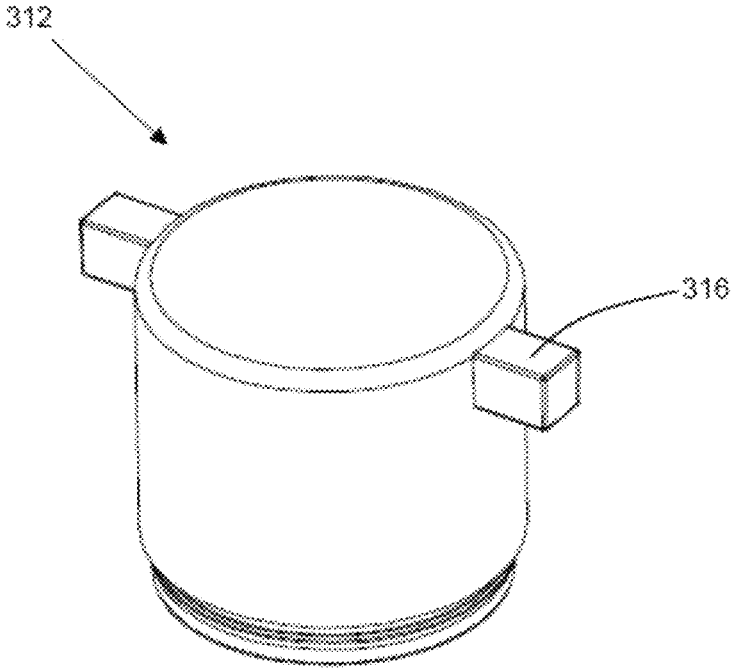
FIG. 6D is an isometric view of a repository for a dispenser system, such as the dispenser system of FIG. 6A, in accordance with an embodiment of the present disclosure.

Referring now to FIGS. 6A through 14, beauty preparation dispenser systems 300 are described. A dispenser system 300 includes a dispenser (e.g., a beauty preparation container 302), a fragrance container including a fragrance repository 312, and a pump assembly 304. With reference to FIG. 6A, the pump assembly 304 can include at least a first pump 306 having at least one hollow dip tube 308 mounted thereunder. The dip tube 308 is configured to extend beneath the pump assembly 304 and contact a first liquid stored within the container 302. For example, the lower portion 328 of the container 302 can form a cavity (e.g., a first reservoir 303 defined within a housing 301) for housing a first fluid (e.g., the first liquid) to be dispensed from the beauty preparation dispenser system. In some embodiments, the first liquid includes an unscented liquid (e.g., unscented shampoo, unscented conditioner, unscented lotion, etc.). In embodiments of the disclosure, the first pump 306 includes a first pumping mechanism in fluid communication with the first reservoir 303 for dispensing the first fluid from the first reservoir. The first pumping mechanism has a first longitudinal passage 321A for receiving the fluid dispensed from the first reservoir 303, where the first longitudinal passage 321A extends along a first longitudinal axis from proximate to the first reservoir 303 into fluid communication with a nozzle 324. The first longitudinal passage 321A is also in fluid communication with a mixing chamber 322 (e.g., for mixing the first and second fluids together prior to dispensing them from the beauty preparation dispenser system 300).

In embodiments, the pump assembly 304 can include at least a second pump 310 configured to contact the repository 312. The repository 312 is removably coupled with the container 302. In some embodiments, an upper portion 314 of the container 302 is configured to removably couple with the repository 312. For example, the repository 312 can include one or more protrusions (e.g., tabs 316) configured to mate with corresponding apertures 318 of the upper portion 314 (e.g., as described with reference to FIGS. 6C and 9 through 14). The repository 312 may also include a threaded end configured to mate with a corresponding threaded aperture of the upper portion 314. In some embodiments, at least a portion of the second pump 310 is housed within the repository 312. Alternatively, the entirety of the pump assembly 304 can be housed within the container 302.

In embodiments, the second pump 310 is configured to contact a second fluid (e.g., a second liquid) housed within the repository 312 to be dispensed from the beauty preparation dispenser system. For example, the repository 312 can include a second reservoir (e.g., a fluid reservoir 320) to store the second liquid. In some embodiments, the second liquid includes a scented liquid (e.g., a liquid fragrance). The second pump 310 includes a second pumping mechanism in fluid communication with the fluid reservoir 320 for dispensing the second fluid from the fluid reservoir. The second pumping mechanism has a second longitudinal passage 321B for receiving the fluid dispensed from the fluid reservoir 320, where the second longitudinal passage 321B extends along a second longitudinal axis from proximate to the fluid reservoir 320 into fluid communication with the nozzle 324 when the fragrance repository 312 is coupled with the beauty preparation container 302. The second longitudinal passage is also in fluid communication with the mixing chamber 322 (e.g., for mixing the first and second fluids together prior to dispensing them from the beauty preparation dispenser system 300). In embodiments of the disclosure, the second longitudinal axis is at least substantially parallel to the first longitudinal axis. Further, the first longitudinal axis and the second longitudinal axis are at least substantially parallel to the pumping action direction of the beauty preparation dispenser system 300. In some embodiments (e.g., as described with reference to FIGS. 6A and 7A), the first longitudinal axis of the first longitudinal passage 321A and the second longitudinal axis of the second longitudinal passage 321B are at least substantially coaxial with one another (e.g., sharing a common longitudinal axis 323).

The pump assembly 304 can include at least one mixing chamber 322 disposed between the first pump 306 and the second pump 310. Upon actuation of the assembly 300, each of the first liquid and the second liquid enter the mixing chamber 322, as described below. A passage 330 connects the mixing chamber 322 to a nozzle 324 of the pump assembly 304 for dispensing of the mixed liquid. In some embodiments, the mixing chamber 322 can include one or more mixing members (e.g., a static mixer, a bit, a spring, teeth, etc.). The static mixer is configured to provide mixing of liquids within the mixing chamber 322. For example, as liquid(s) pass through the mixing chamber 322, the static mixer continuously blends the liquids to substantially simultaneously produce both flow diversion and radial mixing. The liquids flow through the static mixer in an alternating clockwise/counter-clockwise pattern. In embodiments, the static mixer includes one or more mixing elements (e.g., baffles). The number of baffles can be selected based on the desired level of stratification of the liquids. For example, at each succeeding baffle, the liquids are further divided, resulting in an exponential increase in stratification. In embodiments, the baffles can be arranged in a helical configuration. However, these embodiments are offered by way of example only and are not meant to be restrictive of the present disclosure. In other embodiments, the mixing chamber 322 can form a through passage to the nozzle 324 with no mixing member. In still other embodiments, the pump assembly can include dual mixing chambers, as described above.

Referring still to FIGS. 6A through 14, an actuator 326 is disposed between the upper portion 314 and the lower portion 328 of the container 302. The actuator 326 can include one or more biasing members (e.g., springs) configured for biasing the actuator 326 and one or more portions of the pump assembly. The actuator 326 can be coupled with the mixing chamber 322 in such a manner that when the actuator 326 is pressed, the mixing chamber 322 may also move downward. In some embodiments, the repository 312 can be coupled with the actuator 326 in such a manner that the repository 312 forms a pressing member to facilitate depression of the actuator 326. For example, when the repository 312 is depressed, the actuator 326 also moves downward.

In operation, depression of the actuator 326 substantially simultaneously draws the first and second fluids into the mixing chamber 322. For example, depression of the actuator 326 can form a negative pressure reservoir within the mixing chamber 322, allowing the mixing chamber 322 to communicate with the first pump 306 and the second pump 310. With reference to FIG. 6A, the negative pressure vacuum draws the first liquid up through the hollow dip tube 308 and substantially simultaneously draws the second liquid from the fluid reservoir 320. The first liquid and the second liquid can then mix in the mixing chamber 322 to form a liquid mixture. For example, an unscented shampoo can be mixed with a fragranced liquid to form a fragranced liquid mixture. If the actuator 326 is further depressed and/or pressed downward again, the liquid mixture stored in the mixing chamber 322 will flow through the passage 330 to be discharged out of the nozzle 324. In some embodiments, the liquid mixture can flow through the static mixer in an alternating clockwise/counter-clockwise pattern, as described above, providing both flow diversion and radial mixing to increase homogeneity of the liquid mixture. The dual pumps of the pump assembly 304 permit the liquid mixture to flow from the mixing chamber 322 through the passage 330 and upwards towards the nozzle 324, while preventing backflow of the liquid mixture into the container 102 and/or the fluid reservoir 320. However, it is to be understood that the dual pump configuration is offered by way of example only and is not meant to be restrictive of the present disclosure. In other embodiments, one or both pumps and/or dip tubes may be replaced with passthroughs or other mechanical mechanisms (e.g., airless pump and piston assembly described below in reference to FIG. 7A) for allowing the first and second liquids to enter the mixing chamber 322. The dispenser system 300 may further include plugs or other sealing members to further prevent unwanted intermixing of the first and second liquids. It is to be further understood, that the pump assembly 304 may employ one or more pistons and/or valves, as described above, to draw the first and/or second liquids into the mixing chamber 322.

Because the repository 312 is removably coupled with the container 302, multiple repositories 312 can be utilized interchangeably with the container 302. For example, one container of unscented shampoo can be utilized with multiple repositories 312, each containing a different scented liquid 114. In some embodiments, at least a portion of the repository 312 is formed from a transparent, translucent, semi-translucent, and/or semi-transparent material, allowing for visibility of at least a portion of the second liquid. In this manner, the type of liquid housed within the repository 312 may be readily identifiable by its appearance (e.g., different fragrances can be associated with a different color). It is to be understood that while the repository 312 is illustrated as a detachable cap (e.g., connecting with the upper portion 314 of the container 302, this embodiment is offered by way of example only and is not meant to be restrictive of the present disclosure. In other embodiments, the repository 312 may be removably coupled with other portions of the container 302, such as the lower portion 328.

In some embodiments, the upper portion 314 and lower portion 328 of the container may be formed as separate sections. In such embodiments, the upper portion 314 and lower portion 328 can be securely connected to prevent leakage of the liquids housed therein.

Figure 7A:
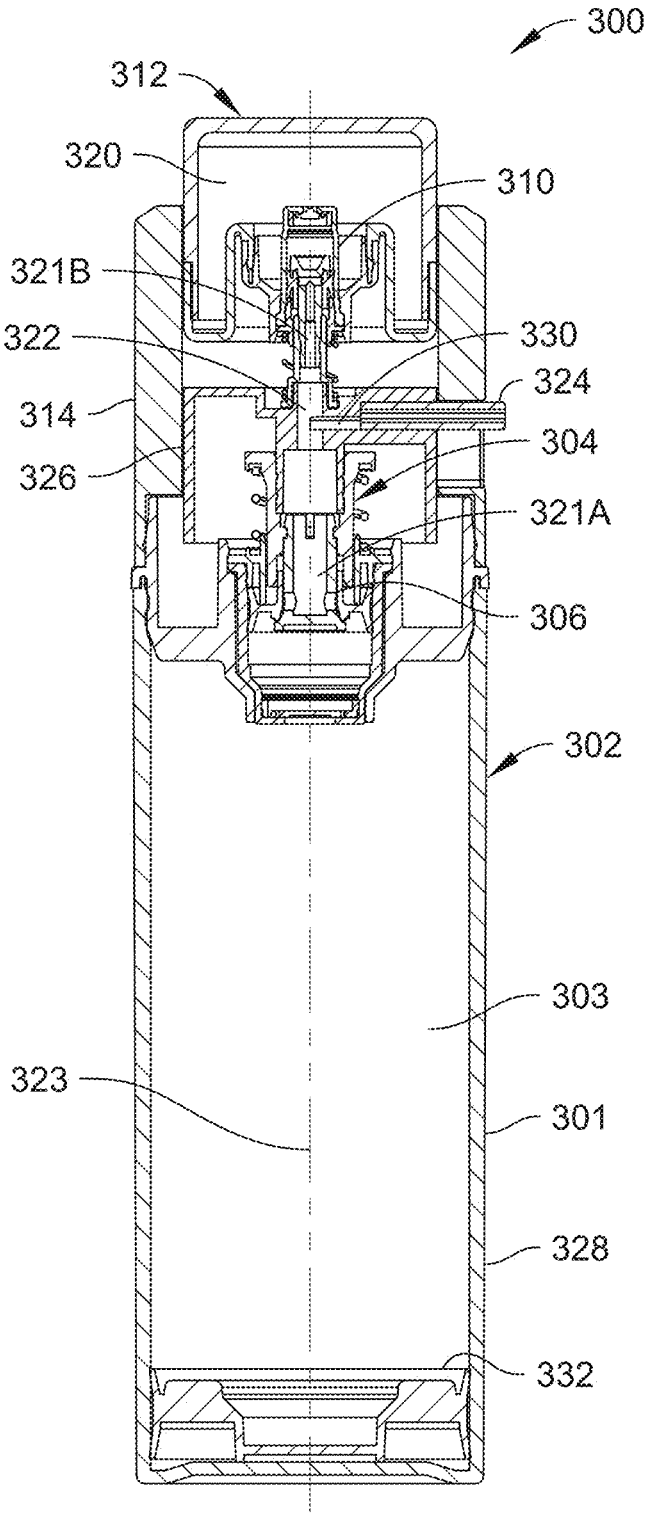
FIG. 7A is a longitudinal cross-sectional view of a dispenser system in accordance with an example embodiment of the present disclosure.
Figure 7B:
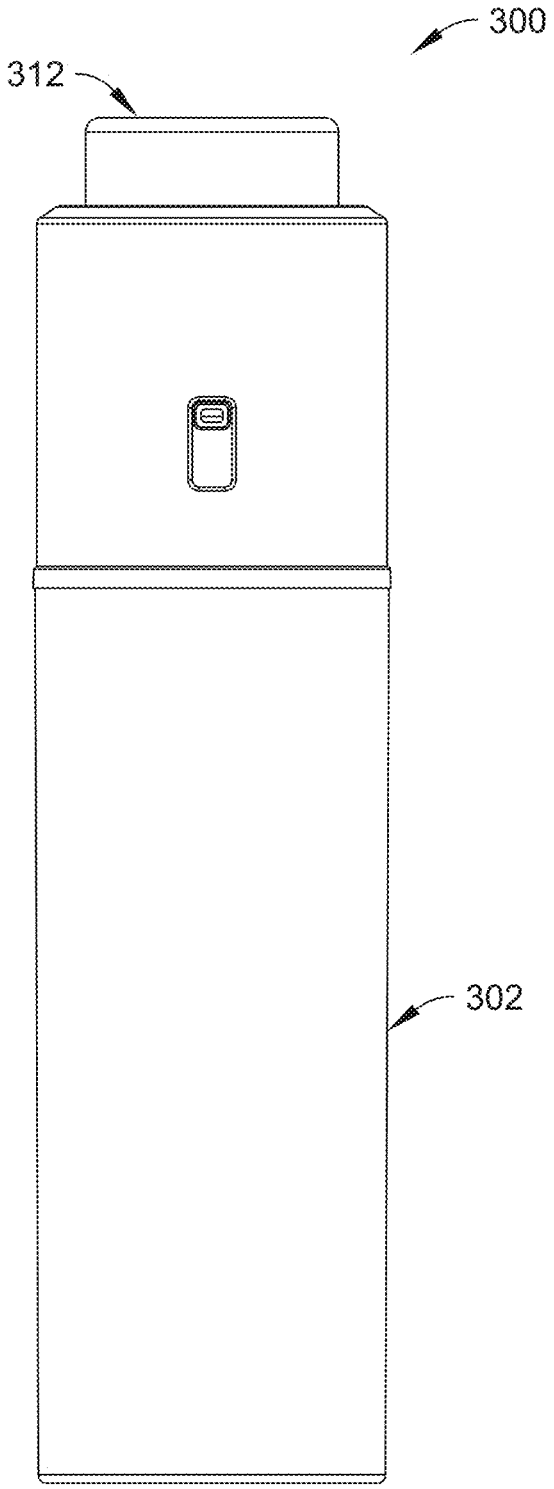
FIG. 7B is a front view of a dispenser system, such as the dispenser system of FIG. 7A, in accordance with an embodiment of the present disclosure.
Figure 8:
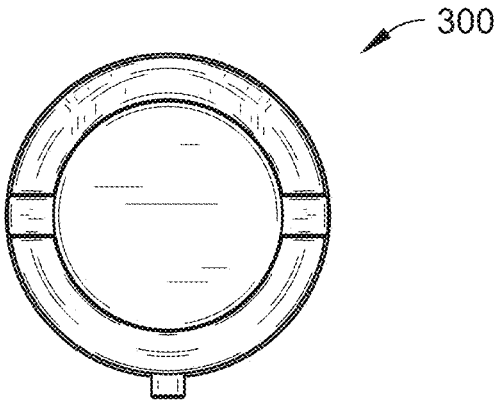
FIG. 8 is a top plan view of a dispenser system, such as the dispenser system illustrated in FIG. 7A, in accordance with an example embodiment of the present disclosure.
Figure 9:
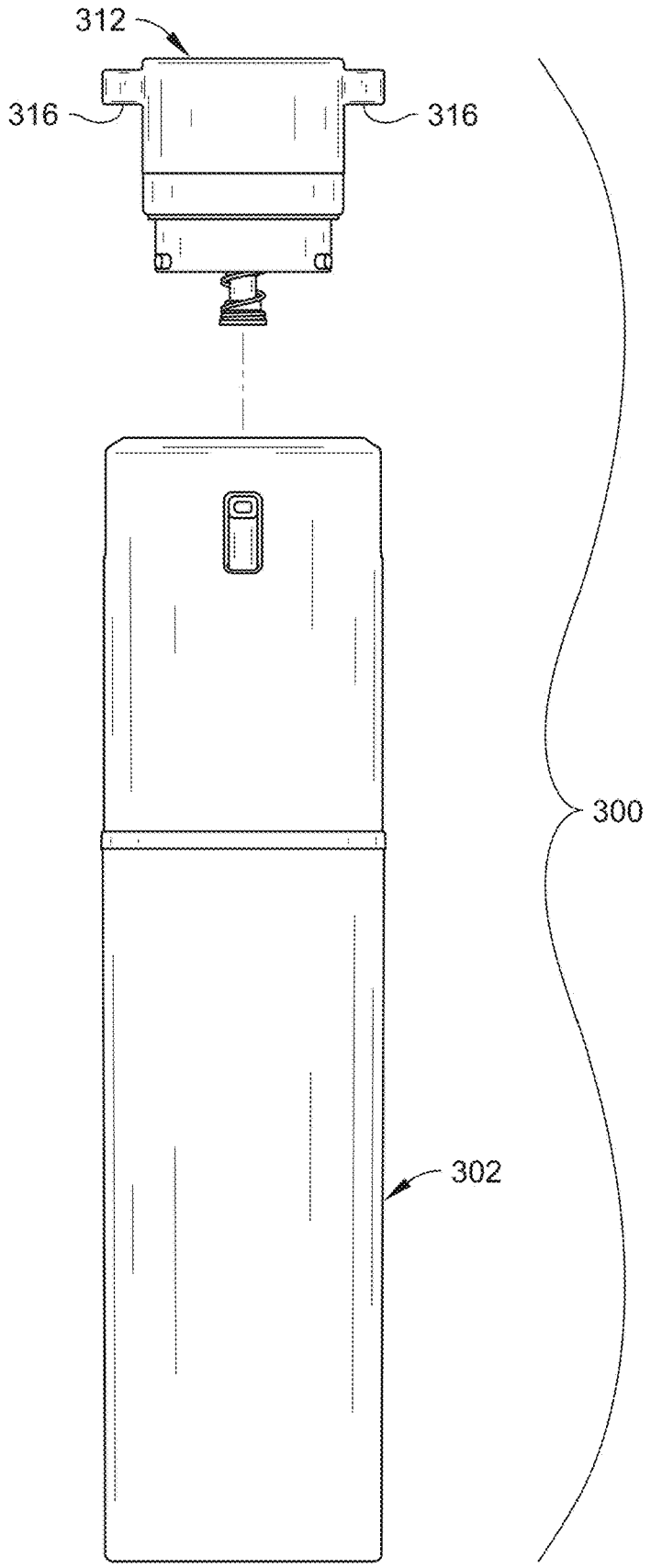
FIG. 9 is an exploded front elevation view of the dispenser system of FIG. 8.
Figure 10:
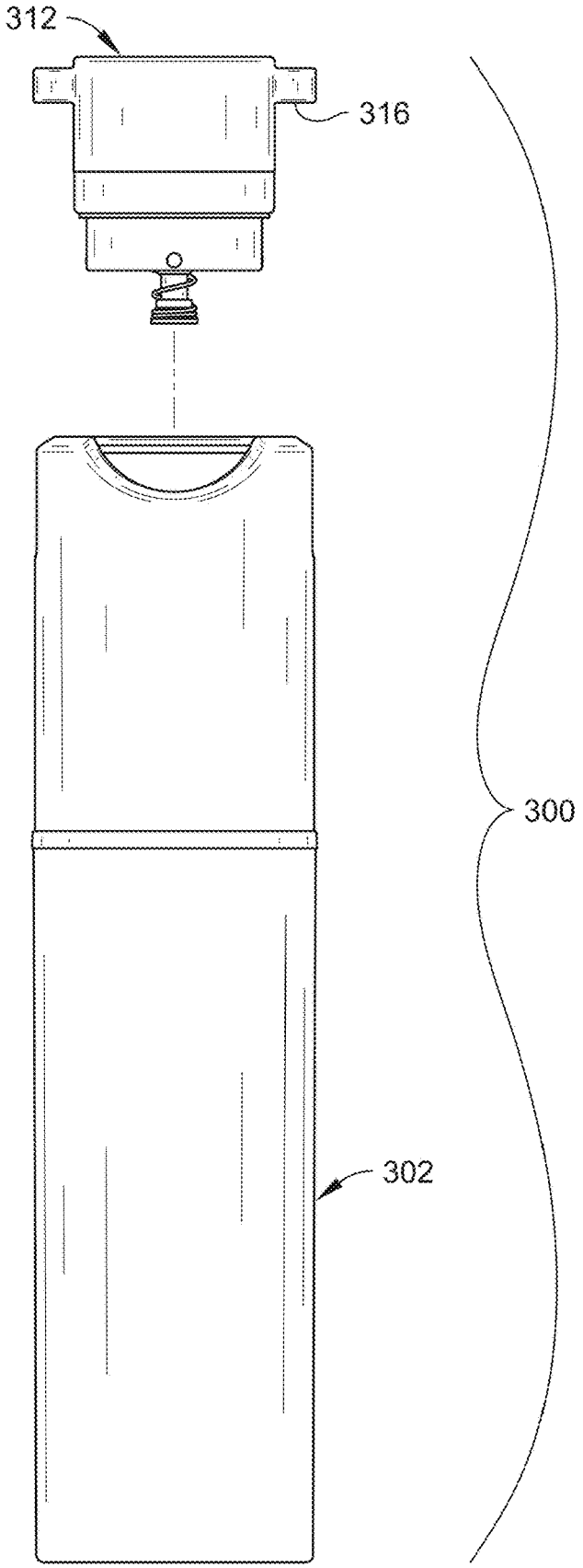
FIG. 10 is an exploded rear elevation view of the dispenser system of FIG. 8.
Figure 11:
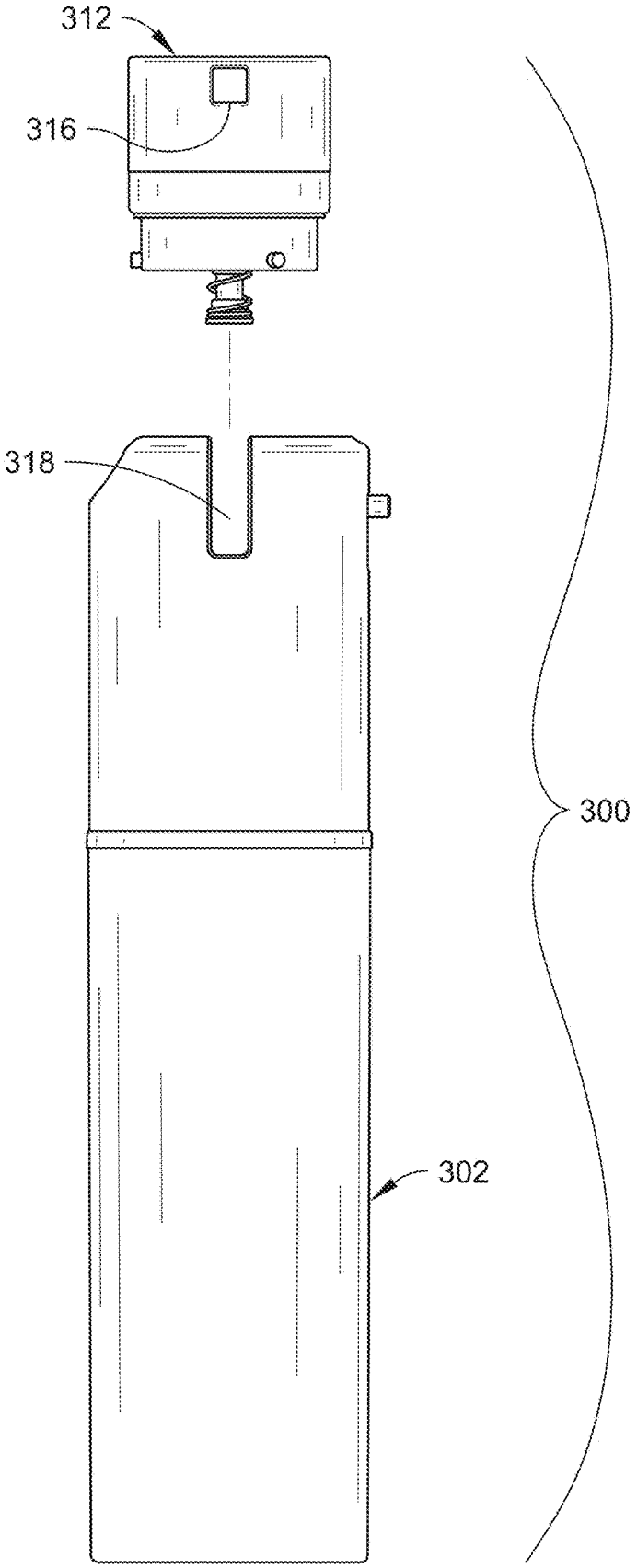
FIG. 11 is an exploded side elevation view of the dispenser system of FIG. 8.
Figure 12:
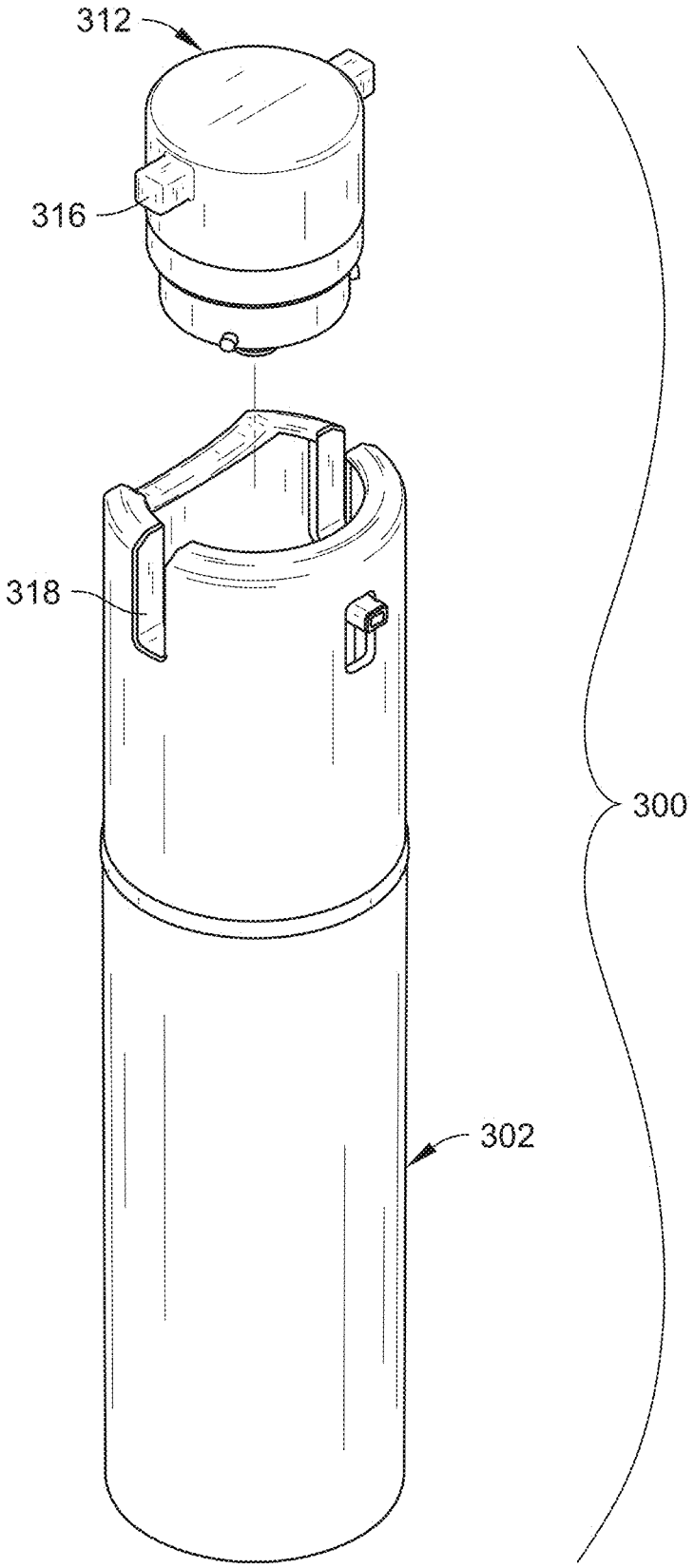
FIG. 12 is an exploded isometric view of the dispenser system of FIG. 8.
Figure 13:
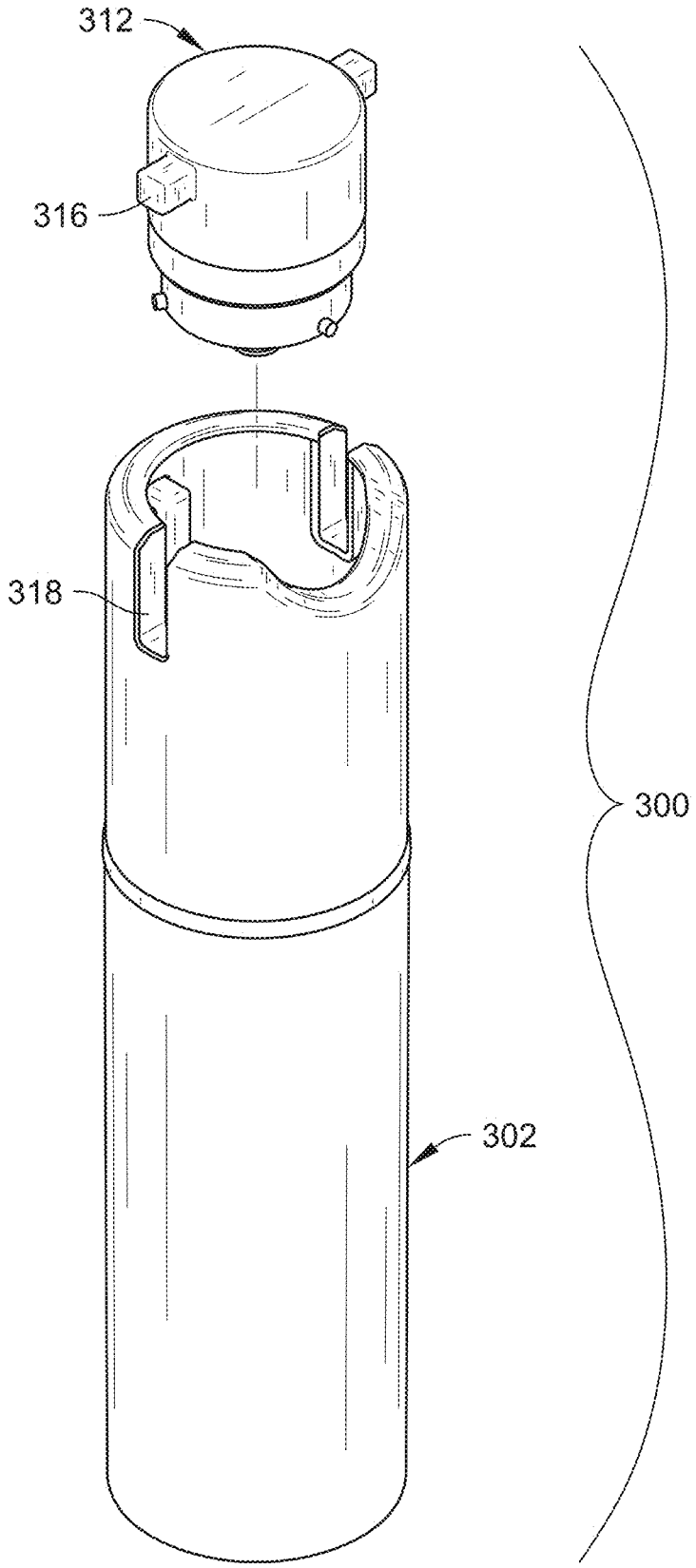
FIG. 13 is another exploded isometric view of the dispenser system of FIG. 8.
Figure 14:
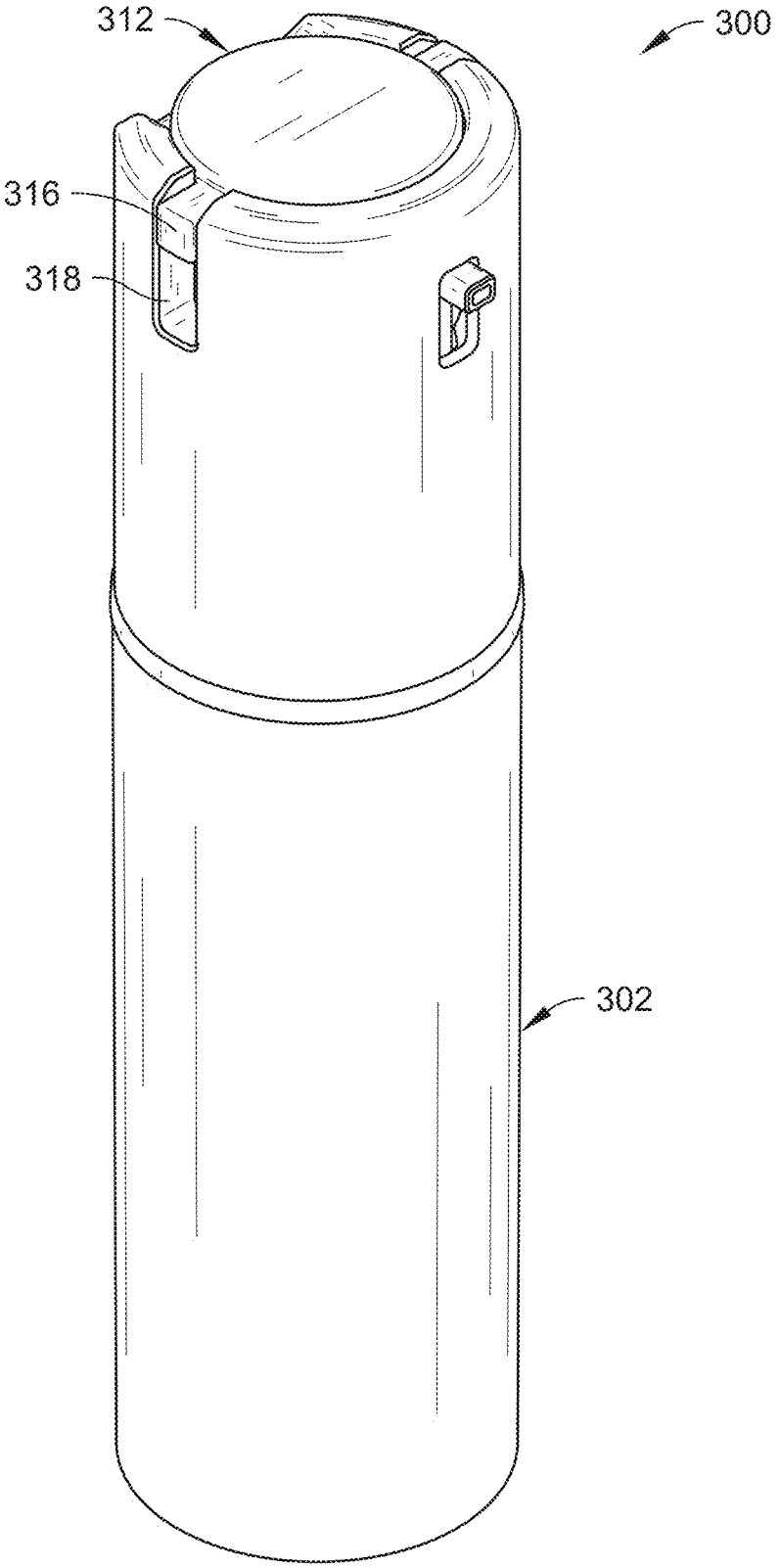
FIG. 14 is an isometric view of the dispenser system of FIG. 8.

Referring now to FIGS. 7A and 7B, the pump assembly 304 can include at least one airless pump, such as a first airless pump 306 and/or a second airless pump 310. For example, an airless pump can be disposed in the upper portion of the container 302. In such embodiments, the container 302 may include a double-walled housing, and a substantially airtight configuration. The container 302 can house a moveable piston 332 disposed in the container cavity. The moveable piston 332 is sealingly engaged with the wall of the housing, allowing slidable upward movement therein. When the actuator is depressed (e.g., depression of the pressing member and/or the repository 312), the piston slides upward, pushing the first liquid upward into the mixing chamber 322. Somewhat simultaneously, the second liquid can be pulled downward from the repository 312 into the mixing chamber 322, forming a liquid mixture. The liquid mixture is dispensed through the nozzle 324. In such embodiments, the container 302 may include one or more vent openings (e.g., proximate to the base of the container 302) for maintaining pressure within the container and/or allowing release of air during initial priming of the pump 306. The vent opening can be of a small size to prevent leakage of viscous fluids. In some embodiments, the second pump 310 may also be configured as an airless pump (e.g., working in the same manner as the first pump 306 with a substantially airtight configuration and a moveable piston). In some embodiments, the second pump 310 may also be a pump that includes a tube (e.g., as described with reference to FIGS. 1 through 6D).

It is to be understood that, while the dispenser systems are generally described above in reference to adding a fragrance to an unscented shampoo, they can also be utilized to add fragrances to other unscented beauty and/or cleansing preparations (e.g., conditioner, lotion, hand soap, cleaning agents, etc.), or to alter the fragrance of a scented beauty preparation. It is also contemplated that, while the dispenser systems can be utilized as described above to form a scented liquid mixture, they can also be utilized to form other liquid mixtures. For example, the dispenser system can be utilized to infuse coloration, nutrients (e.g., vitamins, proteins, etc.), and so forth into a liquid. It is to be further understood that the dispenser system can include one or more additional dip tubes and/or fragrance reservoirs configured for housing additional fragrances or other liquids (e.g., coloration, nutrients, etc.).

It is to be further understood that the dispenser systems described above may be utilized with liquids other than beauty or cleansing products. The dispenser systems described above can be utilized for other applications requiring the mixing of two or more liquids and/or semi-liquids. For example, the dispenser systems described above may be utilized in pharmaceutical compounding for combining two or more liquid or semi-liquid (e.g., lotions, creams, etc.) pharmaceutical agents. The dispenser systems described above may also be utilized in for mixing beverages (e.g., for combining a first liquid beverage ingredient with at least a second liquid beverage ingredient).

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A beauty preparation dispenser system comprising:

a beauty preparation container including:

a housing defining a first reservoir for holding a first fluid to be dispensed from the beauty preparation dispenser system, a first pumping mechanism in fluid communication with the first reservoir for dispensing the first fluid from the first reservoir, and a nozzle for receiving the first fluid dispensed from the first reservoir and dispensing the first fluid from the container, the first pumping mechanism having a first longitudinal passage for receiving the first fluid dispensed from the first reservoir, the first longitudinal passage extending from proximate to the first reservoir into fluid communication with the nozzle, the first longitudinal passage extending along a first longitudinal axis; and a fragrance container including:

a fragrance repository removably couplable with the beauty preparation container, the fragrance repository defining a second reservoir for holding a second fluid to be dispensed from the beauty preparation dispenser system, and a second pumping mechanism in fluid communication with the second reservoir for dispensing the second fluid from the second reservoir, the second pumping mechanism having a second longitudinal passage for receiving the second fluid dispensed from the second reservoir, the second longitudinal passage extending from proximate to the second reservoir into fluid communication with the nozzle when the fragrance repository is coupled with the beauty preparation container, the second longitudinal passage extending along a second longitudinal axis at least substantially parallel to the first longitudinal axis of the first longitudinal passage, the first longitudinal axis of the first longitudinal passage and the second longitudinal axis of the second longitudinal passage at least substantially parallel to a pumping action direction of the beauty preparation dispenser system, the first longitudinal passage and the second longitudinal passage in fluid communication with a mixing chamber for mixing the first fluid and the second fluid together prior to the mixture of first and second fluids being dispensed from the nozzle, the first longitudinal axis of the first longitudinal passage and the second longitudinal axis of the second longitudinal passage at least substantially coaxial with one another.

2. The beauty preparation dispenser system as recited in claim 1, wherein the first fluid comprises an unscented liquid and the second fluid comprises a scented liquid.

3. The beauty preparation dispenser system as recited in claim 1, wherein at least one of the first pumping mechanism or the second pumping mechanism comprises an airless pumping mechanism.

4. The beauty preparation dispenser system as recited in claim 1, wherein the beauty preparation container comprises an aperture and the fragrance container comprises a tab configured to mate with the aperture.

5. The beauty preparation dispenser system as recited in claim 1, wherein a mixing ratio of the first fluid to the second fluid dispensed from the nozzle is between about 1:0.005 and about 1:0.05.

6. The beauty preparation dispenser system as recited in claim 1, further comprising at least one mixing element disposed within the mixing chamber.

7. The dispenser system as recited in claim 1, wherein the fragrance container is configured to move with respect to the beauty preparation container by the pumping action of the beauty preparation dispenser system.

8. A beauty preparation dispenser system comprising:

a beauty preparation container including:

a housing defining a first reservoir for holding a first fluid to be dispensed from the beauty preparation dispenser system, a first pumping mechanism in fluid communication with the first reservoir for dispensing the first fluid from the first reservoir, and a nozzle for receiving the first fluid dispensed from the first reservoir and dispensing the first fluid from the container, the first pumping mechanism having a first longitudinal passage for receiving the first fluid dispensed from the first reservoir, the first longitudinal passage extending from proximate to the first reservoir into fluid communication with the nozzle, the first longitudinal passage extending along a first longitudinal axis; and a fragrance container including:

a fragrance repository removably couplable with the beauty preparation container, the fragrance repository defining a second reservoir for holding a second fluid to be dispensed from the beauty preparation dispenser system, and a second pumping mechanism in fluid communication with the second reservoir for dispensing the second fluid from the second reservoir, the second pumping mechanism having a second longitudinal passage for receiving the second fluid dispensed from the second reservoir, the second longitudinal passage extending from proximate to the second reservoir into fluid communication with the nozzle when the fragrance repository is coupled with the beauty preparation container, the second longitudinal passage extending along a second longitudinal axis at least substantially parallel to the first longitudinal axis of the first longitudinal passage, the first longitudinal axis of the first longitudinal passage and the second longitudinal axis of the second longitudinal passage at least substantially parallel to a pumping action direction of the beauty preparation dispenser system, the first longitudinal passage and the second longitudinal passage in fluid communication with a mixing chamber for mixing the first fluid and the second fluid together prior to the mixture of first and second fluids being dispensed from the nozzle.

9. The beauty preparation dispenser system as recited in claim 8, wherein the first longitudinal axis of the first longitudinal passage and the second longitudinal axis of the second longitudinal passage are at least substantially coaxial with one another.

10. The beauty preparation dispenser system as recited in claim 8, wherein the first fluid comprises an unscented liquid and the second fluid comprises a scented liquid.

11. The beauty preparation dispenser system as recited in claim 8, wherein at least one of the first pumping mechanism or the second pumping mechanism comprises an airless pumping mechanism.

12. The beauty preparation dispenser system as recited in claim 8, wherein the beauty preparation container comprises an aperture and the fragrance container comprises a tab configured to mate with the aperture.

13. The beauty preparation dispenser system as recited in claim 8, wherein a mixing ratio of the first fluid to the second fluid dispensed from the nozzle is between about 1:0.005 and about 1:0.05.

14. The beauty preparation dispenser system as recited in claim 8, further comprising at least one mixing element disposed within the mixing chamber.

15. A dispenser system comprising:

a housing defining a first reservoir for holding a first fluid to be dispensed from the dispenser system;

a first pumping mechanism in fluid communication with the first reservoir for dispensing the first fluid from the first reservoir;

a nozzle for receiving the first fluid dispensed from the first reservoir and dispensing the first fluid from the container, the first pumping mechanism having a first longitudinal passage for receiving the first fluid dispensed from the first reservoir, the first longitudinal passage extending from proximate to the first reservoir into fluid communication with the nozzle, the first longitudinal passage extending along a first longitudinal axis;

a fragrance repository defining a second reservoir for holding a second fluid to be dispensed from the dispenser system;

a second pumping mechanism in fluid communication with the second reservoir for dispensing the second fluid from the second reservoir, the second pumping mechanism having a second longitudinal passage for receiving the second fluid dispensed from the second reservoir, the second longitudinal passage extending from proximate to the second reservoir into fluid communication with the nozzle, the second longitudinal passage extending along a second longitudinal axis;

the first longitudinal passage and the second longitudinal passage in fluid communication with a mixing chamber for mixing the first fluid and the second fluid together prior to the mixture of first and second fluids being dispensed from the nozzle.

16. The dispenser system as recited in claim 15, wherein the fragrance repository is removably couplable with the housing.

17. The dispenser system as recited in claim 15, wherein the first fluid comprises an unscented liquid and the second fluid comprises a scented liquid.

18. The dispenser system as recited in claim 15, wherein at least one of the first pumping mechanism or the second pumping mechanism comprises an airless pumping mechanism.

19. The dispenser system as recited in claim 15, wherein the housing comprises an aperture and the fragrance container comprises a tab configured to mate with the aperture.

20. The dispenser system as recited in claim 15, wherein a mixing ratio of the first fluid to the second fluid dispensed from the nozzle is between about 1:0.005 and about 1:0.05.

21. The dispenser system as recited in claim 15, further comprising at least one mixing element disposed within the mixing chamber.

* * * * *